US006119311A

United States Patent [19]

Lavallee

[11] Patent Number: 6,119,311

[45] Date of Patent: Sep. 19, 2000

[54] MULTIPURPOSE ANGULARLY ADJUSTABLE TOOL HANDLE

[76] Inventor: Julien E. Lavallee, 835 Paradise Blvd., Tarpon Springs, Fla. 34689

[21] Appl. No.: 09/136,198

[22] Filed: Aug. 19, 1998

[51] Int. Cl.[7] ..... A46B 5/02

[52] U.S. Cl. ..... 16/436; 16/900; 15/144.1; 15/172

[58] Field of Search ..... 15/144.1, 172; 16/436, 437, 438, 900

[56] References Cited

U.S. PATENT DOCUMENTS

| | | | |
|---|---|---|---|
| 701,507 | 6/1902 | Richardson | 15/144.1 |
| 855,152 | 5/1907 | Wilson | 15/144.1 |
| 2,244,585 | 6/1941 | Tweit | 16/426 |
| 2,278,283 | 3/1942 | Raptis | 15/144.1 |
| 2,645,874 | 7/1953 | Collins | 16/900 |
| 2,864,110 | 12/1958 | Bruger . | |
| 3,866,257 | 2/1975 | Cansdale, Sr. . | |
| 4,524,484 | 6/1985 | Graham . | |
| 4,854,625 | 8/1989 | Eubanks et al. . | |
| 5,220,707 | 6/1993 | Newman, Sr. et al. . | |
| 5,249,886 | 10/1993 | Huerta, Jr. . | |
| 5,333,349 | 8/1994 | Lister . | |
| 5,414,889 | 5/1995 | Sartori . | |
| 5,566,418 | 10/1996 | Steffen et al. . | |
| 5,579,558 | 12/1996 | Newman, Jr. et al. . | |
| 5,593,460 | 1/1997 | Lessard . | |
| 5,603,138 | 2/1997 | Bonis . | |
| 5,791,006 | 8/1998 | Anctil | 16/427 |
| 5,842,488 | 12/1998 | Belleau | 15/144.1 |

FOREIGN PATENT DOCUMENTS

| | | | |
|---|---|---|---|
| 243821 | 1/1947 | Switzerland | 15/144.1 |

*Primary Examiner*—Chuck Y. Mah
*Assistant Examiner*—Donald M. Gurley
*Attorney, Agent, or Firm*—Kenneth L Tolar

[57] ABSTRACT

A multi-purpose adjustable tool handle includes an elongated hollow tubular handle member having a sleeve rotatably coupled to a first end thereof. The sleeve is in communication with an elongated drive shaft co-axially received within the handle. An arcuate arm is pivotally secured to an opposing end of the handle with a gear assembly communicating with the shaft. Accordingly, a user may pivot the arm to a desired position by rotating the sleeve relative to the handle. Any one of a number of heads may be attached to the distal end of the arm such as cleaning brushes, rollers, paint brushes, mops and similar devices.

6 Claims, 1 Drawing Sheet

MULTIPURPOSE ANGULARLY ADJUSTABLE TOOL HANDLE

BACKGROUND OF THE INVENTION

The present invention relates to a multi-purpose tool handle that allows a user to selectively position the head in order to reach inaccessible locations.

DESCRIPTION OF THE PRIOR ART

Cleaning or painting relatively inaccessible locations such as ceilings, corners or behind stationary objects has always been problematic for workers. A conventional cleaning or painting tool handle usually includes a fixed head such as a brush, mop or roller on an end thereof. In order to position the head in such hard to reach areas, the handle must be continuously manipulated in various directions which is cumbersome and places a significant strain on the user's back and wrists. Also, the conventional tool head will not adequately engage certain hard to reach areas regardless of the handle position.

The present invention provides a multi-purpose handle having a pivotable arm at a distal end allowing a tool head attached thereto to access various remote locations. Various cleaning and painting tools exist in the prior art. For example, U.S. Pat. No. 4,524,484 issued to Graham relates to a tool extender having a pair of elongated, telescopically coupled extension members and a locking assembly for locking the members in a selected position.

U.S. Pat. No. 5,579,558 issued Newman et. al. relates to an extension handle comprising first and second tubular pole members, one telescopically received within the other. A locking device is included for maintaining the handle in an adjusted position.

U.S. Pat. No. 5,593,460 issued to Lessard relates to a tool handle with a locking mechanism on a first end for locking a tool thereon.

U.S. Pat. No. 3,866,257 issued to Cansdale, Sr. relates to an arm extender tool comprising a pair of spaced arcuate extending members joined at one end by a connecting member. A sponge or a similar device is pivotally attached to the connecting member with a clip. A handle member and a forearm securing means are provided at the opposing ends of the arcuate members.

U.S. Pat. No. 2,864,110 issued to Bruger relates to a paint roller comprising an elongated handle with a paint roller pivotally attached to an end thereof.

U.S. Pat. No. 2,864,110 issued to issued to Bruger relates to a shaft and holder for cleaning elements comprising a telescopic shaft and a clamping head at a distal end thereof.

Although tools having pivoting heads exist in the prior art, the conventional pivoting heads may not be quickly and conveniently fixed in a desired position according to the present invention. The present invention provides a handle having an arcuate arm pivotally mounted thereto with a tool head at a distal end. The arcuate arm allows the head to circumvent obstructions and to extend outwardly from the handle. The arm may be easily pivoted to a desired position by rotating a sleeve at an opposing end of the handle.

SUMMARY OF THE INVENTION

The present invention relates to a universal tool handle for reaching inaccessible locations. The device comprises an elongated hollow tubular handle member having first and second ends with a sleeve rotatably attached to a first end thereof. The sleeve is in communication with a drive shaft coaxially received within the handle. The shaft drives a first gear disposed at the second end of the handle whenever the sleeve is rotated. A second gear engages the first gear and drives a shaft having an arcuate arm secured thereto. A tool head such as a mop or broom is attachable to a distal end of the arm. Accordingly, the position of the tool head relative to the shaft may be selectively adjusted by rotating the sleeve. A tensioning means is also provided to prevent the weight of the tool head from pivoting the arm out of position. It is therefore an object of the present invention to provide a tool handle in which the position of the tool head may be selectively adjusted relative to the handle.

It is yet another object of the present invention to provide a tool in which the head may be angularly adjusted with minimal effort.

It is yet another object of the present invention to provide a tool having a pivoting head which may be selectively locked in a desired position.

Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
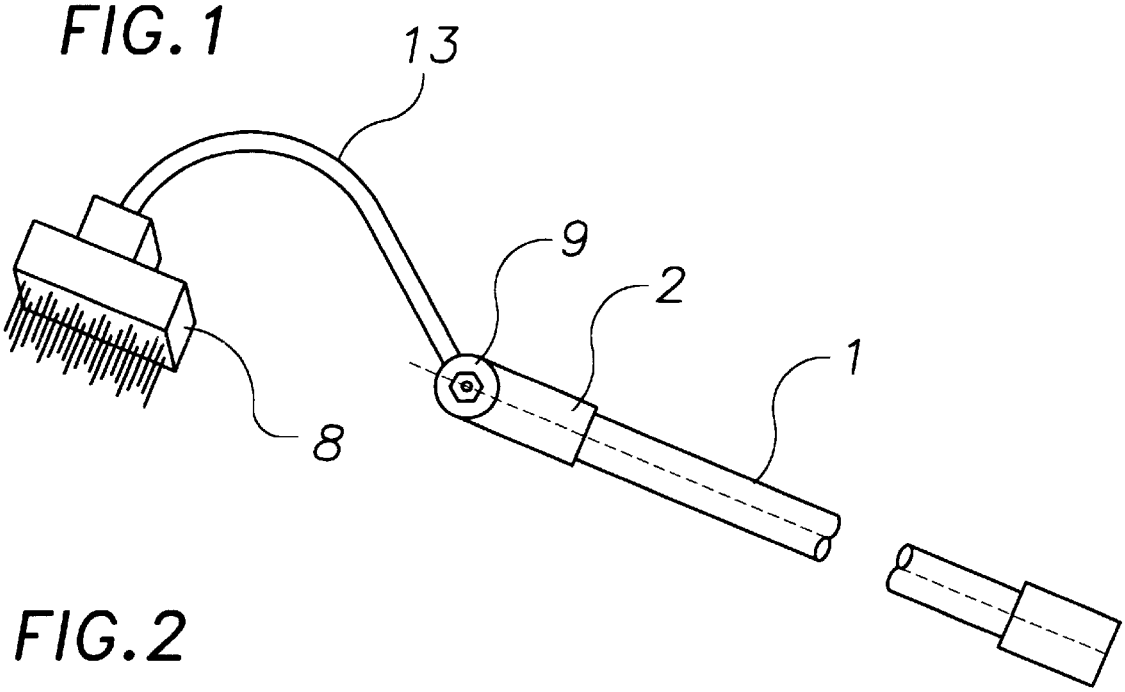
FIG. 1 is a perspective view of the inventive device.
Figure 2:
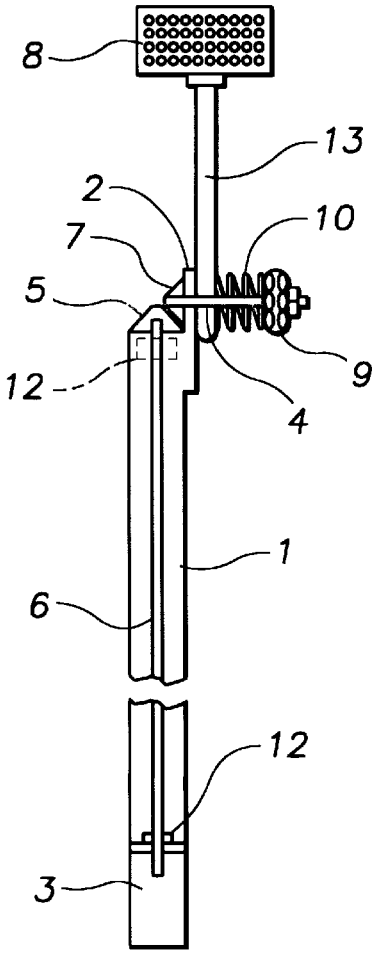
FIG. 2 is a side view of the inventive device, depicting the internally disposed drive shaft.
Figure 3:
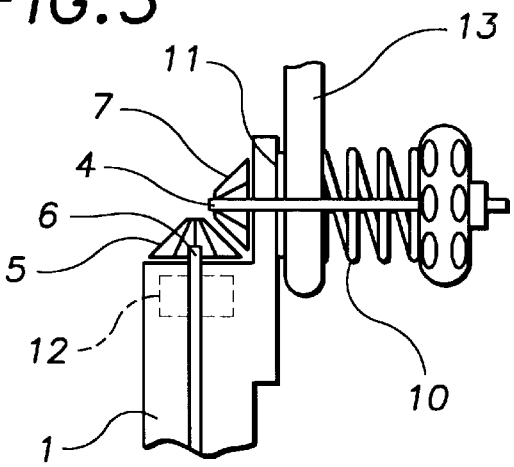
FIG. 3 depicts a close-up view of the drive mechanism for the pivoting arm.

Referring now to FIGS. 1 through 3, the present invention relates to a multi-purpose tool handle having an adjustment mechanism that allows the tool head to be selectively positioned relative to the handle. The device comprises an elongated, hollow tubular handle member 1 having first and second ends. The first end of the handle has a lip 2 integrally extending therefrom, the lip having an inwardly and an outwardly facing side. Rotatably coupled to the second end of the handle is a sleeve 3 in communication with an elongated primary drive shaft 6 co-axially received within the handle. Each end of the axle is preferably received within a bearing 12 to assist the shaft in rotating. Attached to a distal end of the shaft and adjacent the inwardly facing side of the lip is a first beveled gear 5.

An arcuate arm 13 is pivotally secured to the outwardly facing side of the lip with a drive mechanism including a secondary drive shaft 4 having a second beveled gear 7 on an end thereof that cooperatively engages the first beveled gear. Preferably, a portion of the secondary shaft is externally threaded and extends from the arm a predetermined distance. Accordingly, rotation of the sleeve will pivot the arm relative to the handle. Removably attached to a distal end of the arm is a tool head such as a cleaning brush, a mop head, a paint brush, a paint roller or any other similar item.

Now referring to FIG. 3, a tensioning means is depicted for maintaining the arm in a desired position. A knob 9 has an internally threaded bore that threadedly engages the outwardly extending portion of the secondary drive shaft. A coil spring 10 and washer 11 encompass the shaft and are disposed between the knob and the arm. Therefore, the knob may be rotated in a desired direction to compress or expand the spring thereby exerting a selective amount of force on the arm. The tensioning means prevents the arm from pivoting due to the weight of the tool head once the arm is moved to a desired position.

To use the above described device, a desired tool head is placed on the end of the arcuate arm. The knob is rotated to exert a predetermined amount of force against the arm. To move the tool head to a desired position, the sleeve is rotated in either direction until the head is disposed at a desired location relative to the shaft.

A rubber gripping member may be placed over the sleeve for comfort. The handle, shafts and arm are preferably constructed with aluminum while the tool head may be constructed with plastic. However, as will be readily apparent to those skilled in the art, the size, shape and materials of construction may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A multipurpose angularly adjustable tool handle comprising:

an elongated hollow tubular handle member having two opposing ends;

an arcuate arm pivotally secured to a first end of said handle;

means for pivoting said arm to a desired position relative to said handle, said means including a sleeve rotatably secured to a second end of said handle and an elongated primary drive shaft coaxially received within said handle and in communication with said sleeve and said arm whereby said arm pivots relative to said handle when said sleeve is rotated.

2. A multipurpose angularly adjustable tool handle according to claim 1 further comprising:

a tensioning means for applying a predetermined amount of pressure to said arm to prevent said arm from pivoting independently of said pivoting means.

3. A multipurpose angularly adjustable tool handle according to claim 1 wherein said tensioning means comprises:

a spring engaging said arm;

means for compressing said spring against said arm to apply a predetermined amount of pressure thereto.

4. A multipurpose angularly adjustable tool comprising:

an elongated, hollow tubular handle member having two opposing ends with a lip vertically extending from a first end thereof, said lip having an inwardly and an outwardly facing side;

a first gear disposed at the first end of said handle adjacent the inwardly facing side of said lip;

a sleeve rotatably attached to a second end of said handle;

a drive shaft co-axially received within said handle, said shaft establishing communication between said sleeve and said first gear;

a second shaft extending through said lip having a second gear attached to an end thereof, said second gear engaging said first gear;

an arcuate arm having a first end attached to said second shaft and disposed immediately adjacent the outwardly facing side of said lip whereby rotation of said sleeve causes said arm to pivot relative to said handle.

5. A device according to claim 4 further comprising a tensioning means for fixing said arm in a desired position.

6. A device according to claim 5 wherein said tensioning means comprises:

said secondary shaft extending from said arm, a portion of which is externally threaded;

a knob threadedly engaging the threaded portion of said shaft;

a spring disposed between said knob and said arm whereby rotation of the knob compresses said spring to apply a predetermined amount of tension to said arm.

* * * * *